US011203905B2

(12) United States Patent
Schmidt

(10) Patent No.: US 11,203,905 B2
(45) Date of Patent: Dec. 21, 2021

(54) DRILL STRING SECTION FOR DRILLING IN THE GROUND, GROUND DRILLING DEVICE, AND USE OF A DRILL STRING SECTION

(71) Applicant: TRACTO-TECHNIK GMBH & CO. KG, Lennestadt (DE)

(72) Inventor: Wolfgang Schmidt, Kirchhundem (DE)

(73) Assignee: TRACTO-TECHNIK GMBH & CO. KG, Lennestadt (DE)

( * ) Notice: Subject to any disclaimer, the term of this patent is extended or adjusted under 35 U.S.C. 154(b) by 0 days.

(21) Appl. No.: 16/662,289

(22) Filed: Oct. 24, 2019

(65) Prior Publication Data

US 2020/0149355 A1 May 14, 2020

(30) Foreign Application Priority Data

Nov. 9, 2018 (DE) ..... 102018008811.2

(51) Int. Cl.

| | |
|---|---|
| ***E21B 17/00*** | (2006.01) |
| ***E21B 1/00*** | (2006.01) |
| ***E21B 12/02*** | (2006.01) |
| ***E21B 47/00*** | (2012.01) |

(52) U.S. Cl.

CPC ..... *E21B 12/02* (2013.01); *E21B 1/00* (2013.01); *E21B 17/006* (2013.01); *E21B 47/00* (2013.01)

(58) Field of Classification Search

CPC .... E21B 17/006; E21B 17/1085; E21B 17/00; E21B 17/10; E21B 17/16; E21B 17/22; E21B 12/02

See application file for complete search history.

(56) References Cited

U.S. PATENT DOCUMENTS

| | | | | |
|---|---|---|---|---|
| 3,414,272 | A * | 12/1968 | Rogers, Jr. | F16J 9/12 277/321 |
| 3,697,141 | A * | 10/1972 | Garrett | E21B 17/1042 175/325.5 |
| 6,167,833 | B1 * | 1/2001 | Caraway | E21B 12/02 116/208 |
| 6,523,586 | B1 * | 2/2003 | Eromaki | B60C 11/24 152/154.2 |
| 2005/0056420 | A1 * | 3/2005 | Ramey | E21B 3/04 166/250.05 |
| 2006/0005904 | A1 * | 1/2006 | Helt | B60C 11/24 152/154.2 |
| 2006/0071473 | A1 * | 4/2006 | Sivley, IV | F16L 15/004 285/333 |
| 2011/0175343 | A1 * | 7/2011 | Akins | G09F 7/00 283/74 |
| 2012/0125689 | A1 * | 5/2012 | Howlett | E21B 17/1064 175/57 |
| 2012/0306199 | A1 * | 12/2012 | David | B23K 20/12 285/333 |
| 2015/0129313 | A1 * | 5/2015 | Zacharko | H01R 39/08 175/73 |

(Continued)

FOREIGN PATENT DOCUMENTS

| | | |
|---|---|---|
| AU | 42762 97 | 4/1998 |
| WO | 9858153 A1 | 12/1998 |

*Primary Examiner* — Kipp C Wallace
(74) *Attorney, Agent, or Firm* — Howard IP Law Group

(57) ABSTRACT

A drill string section of a drill string for drilling in the ground having arranged on the outside of the drill string section at least one marking by means of which abrasion can be recognized.

19 Claims, 1 Drawing Sheet

(56) References Cited

U.S. PATENT DOCUMENTS

| | | | | |
|---|---|---|---|---|
| 2016/0369565 | A1* | 12/2016 | Purcell | E21B 4/14 |
| 2016/0369926 | A1* | 12/2016 | Shuck | F16L 41/026 |
| 2017/0096863 | A1* | 4/2017 | Blasingame | C09D 1/00 |
| 2018/0202117 | A1 | 7/2018 | Wagner et al. | |

* cited by examiner

DRILL STRING SECTION FOR DRILLING IN THE GROUND, GROUND DRILLING DEVICE, AND USE OF A DRILL STRING SECTION

FIELD OF INVENTION

The invention relates to a drill string section for drilling in the ground, a ground drilling device and a use of a drill string section.

BACKGROUND

From the prior art it is known, for example, how to determine the outer diameter of the housing of a percussion drilling device in an ongoing manner in order to replace the housing when it drops below a minimum degree of the outer diameter. But the measurement instruments needed for the exact measurement of the outer diameter of a percussion drilling device housing are generally lacking at construction sites for percussion drilling devices. Hence, the measurement absolutely necessary for wear identification is often not performed. Likewise, this measurement is also simply forgotten. This necessarily means that percussion drilling gear will continue to be used even when the minimum degree of the outer diameter of the percussion drilling device housing has already been passed. As a consequence, a fracturing of the housing may occur, which may lead to loss of the percussion drilling device in the ground. Furthermore, the earth drilling, once commenced, will not be finished and thus cannot be used.

SUMMARY

Now, the problem which the invention proposes to solve is to be able to identify wear on a drill string section, especially in the form of abrasions in a simple manner.

The key notion of the invention is to provide a marking on the outside of a section of a drill string which is used for making a borehole in the ground, and the alteration of the marking allows an inference as to the abrasion during use. Such abrasion is not confined to a onetime application, but rather the alteration of the marking may provide an inference as to the abrasion during all uses in the event of repeated use of a drill string section. Advantageously, a marking is used which enables an observation with the naked eye and/or an alteration of the marking with the naked eye.

The invention creates a drill string section of a drill string for drilling in the ground. On the outside of the drill string section there is arranged at least one marking by means of which abrasion can be recognized on the outside of the drill string section. This makes possible a simple configuration of a drill string section, whereby a change in the marking allows an inference as to the abrasion, and it can be configured such that a change is recognized for example as soon as the danger of a fracture of the drill string section has occurred. If such a change is recognized, the drill string section can be replaced in order to avoid a fracture of the drill string section and thus possibly a loss of part of the drill string. Advantageously, the marking may be configured such that the change is clearly recognizable with the naked eye, especially in that the marking disappears or is increasingly less recognizable.

The term "drill string" in the sense of the specification encompasses any given means of being introduced into the ground in order to make a borehole in the ground. The drill string may comprise a rod, a chain, and/or a cable. The term "rod" encompasses, in the sense of the specification, not only rigid rods comprising individual directly or indirectly joined rod sections, but also in particular all force transmitting elements which can be used in a ground drilling device. Moreover, the drill string comprises a drilling head at one end, especially the front end, and possibly drill bit tips or a region adjacent to the drill head which may have in particular the same orientation as the drill head. In an especially preferred embodiment, a front section of a drill string is configured as a drill head or drilling tool. In particular, the drill string section may be the housing of a percussion drilling device or displacement hammer.

In the sense of the specification, the term "drill string section" thus encompasses any given section of the drill string, preferably a front-end section of the drill string, especially the drill head or a drill string section adjacent to the drill head. A drill string section may also be a rod section.

The term "ground" in the sense of the present specification encompasses in particular every kind of existing or yet to be created passages or boreholes in a body, preferably being horizontal at least for a portion, especially earth passages, earth boreholes, rock boreholes, or earth conduits, as well as underground or aboveground pipelines and water canals which can be produced or laid by using a corresponding ground drilling device.

By a "ground drilling device" is meant in particular any device which moves a drill string having a rod section in an existing or yet to be created passage in the ground, in order to create or expand a borehole, especially a horizontal drilling (HD), or to lay pipelines or other long bodies in the ground. The ground drilling device in particular may be a HD device. A ground drilling device may thus be a device driving a drill string working by earth displacement and introducing the drill string into the ground by rotation and/or translation in the longitudinally axial direction of the drill string. A borehole can be introduced into the ground by tension or compression applied to the drill string.

The term "HD" (horizontal drilling) in the sense of the present specification encompasses in particular a borehole or passage or pipeline situated horizontally for at least a portion.

The term "at least one" used in the patent claims or in the specification, as well as the article "a, an" used in the patent claims or in the specification—including in corresponding grammatical forms regarding genus and declination—encompasses in regard to the nouns so designated exactly one or more elements designated by the noun, i.e., two, three, four, and so forth.

The term "outside" in the sense of the specification encompasses an outer region of the drill string section which can come into contact with the ground. The outside thus encompasses an exposed region of the drill string section which can usually come into contact with the ground and be exposed to abrasion during normal use. The outside may form a partial section of a cross section of the drill string section, which may be configured in an otherwise typical manner, and on which at least one marking is formed or arranged. The outside may be an outer surface of the drill string section also in an otherwise typical manner.

The term "marking" in the sense of the specification encompasses a structural configuration which is arranged on the outside of the drill string section. The marking can be arranged on the outside and/or be introduced into the outside. The marking may be a change in the surface of the outside of the drill string section which in particular is not introduced and/or applied in detachable manner to the surface of the outside. Insofar as an introducing or applying of the marking to the outside of the drill string section is concerned, this is understood to mean in particular that the outside of the drill string section itself can be changed or modified in order to make the marking. Although a further element may be provided on the drill string section to form the marking, preferably the marking is formed by means of a changing of the surface of the outside of the drill string section with respect to the unchanged surface of the outside on the drill string section. In proper use, abrasion on the outside of the drill string section in the region of the marking may result in a changing of the marking, especially a decreasing of the marking, thereby providing information as to the abrasion or the wear.

In one preferred embodiment, the marking may be a depression introduced into the outside of the drill string section, which can be formed for example by means of milling, lathe turning, or in some other way, especially mechanically. A marking in the sense of the specification is thus preferably a depression arranged on the outside of the drill string section, having preferably at least for a portion an extension in the circumferential direction of the drill string section. The depression in particular may be formed in linear shape along at least part of the circumference of the drill string section. The depression may be formed as a notch. The depression at least for a portion along its extension may be formed symmetrically to its bottom, i.e., the lowest point, relative to the outside of the drill string section. An asymmetry with respect to the bottom of the depression is possible at least for a portion.

The bottom of the depression may be configured with a radius in order to avoid a notch effect. But a tapered bottom of the depression, which may also be present for a portion, is not ruled out.

In one preferred embodiment—if the marking is configured at least for a portion as a depression and at least for a portion along the cross section—the smallest dimension of the "depth", i.e., the bottom of the depression, may correspond to a minimum diameter of a worn drill string section. If abrasion occurs down to the bottom of such a depression, i.e., the marking is almost no longer recognizable, then the minimum diameter of a worn drill string section has been reached. Until reaching the minimum diameter, which is recognized in that the marking at least partly disappears, but is still present, the danger of fracture of the corresponding drill string section is almost ruled out. If the minimum diameter is reached and consequently the marking is almost no longer recognizable, the drill string section can be replaced in order to avoid a fracture of the drill string section and thus possibly the (partial) loss of the drill string.

A marking configured as a depression on the outside of the particular drill string section provides the advantage that a marking is present precisely in the material whose abrasion and the accompanying wear itself is being considered. The inventors have recognized that, even though a marking configured as a depression may bring about a "weakening" of the material of the drill string section, the supposed weakening provides a decisive advantage, by which in particular the minimum diameter of the drill string section can be taken into account, which is not yet reached as long as the marking is recognizable.

Markings, especially depressions, may be associated with different degrees of abrasion or wear. For example, depressions of different depth can indicate that a certain abrasion has already occurred on the drill string section, but the abrasion is still in the noncritical zone—since at least one marking of greater depth can still be recognized.

A marking configured as a depression may have a depth which may depend on the material of the outside or the heat treatment or coating of the outside of the drill string section. Usually, in the sense of the invention, a marking configured as a depression has a depth which is less than 5 mm, preferably less than 4 mm, further preferably less than 3 mm, especially preferably less than 2 mm, particularly preferably less than 1 mm, most especially preferably less than 0.8 mm and most particularly preferably less than 0.5 mm. Markings configured as a depression may have a depth which may be substantially 0.5 mm, substantially 0.3 mm and substantially 0.15 mm.

In the sense of the specification, the designating of a numerical value includes not only the actual numerical value, but also—especially in order to allow for manufacturing tolerances—a region about the actual numerical value, which may be +/−15%, preferably +/−10%, of the indicated numerical value.

In one preferred embodiment, the marking extends entirely around the circumference of the drill string section. The marking may be formed closed around the circumference of the drill string section. In this way, especially in the case of a marking configured uniformly around the circumference of the drill string section, an abrasion recognition is possible in which the entire circumference of the drill string section can be included. In particular, in the case of an uneven loading of the drill string section resulting in uneven, different abrasion along the circumferences of the drill string section, the abrasion can still be identified by a viewing of the entire circumference.

A marking formed along the entire circumference of the drill string section may be arranged in particular in circular form around the lengthwise axis of the drill string section. The circular form may in particular make an angle of substantially 90° with the lengthwise axis of the drill string section. Departures from 90° are possible. There may also be shapes other than a circular form, such as an elliptical form.

It is also possible to form a marking only for a portion along the entire circumference of the drill string section and for no marking to be present between the segments. In this way, a supposed weakening can be further reduced.

In one preferred embodiment, the marking may be configured as a spiral in the circumferential direction of the drill string section. In this way, an easily fabricated and easily recognized marking can be formed. The depth of the encircling spiral marking may for example vary along its course. For example, it is possible for a spirally encircling marking to be configured increasing, especially continuously (for example, from 0 mm to 0.5 mm depth) in a region in the direction of the lengthwise axis of the drill string section, in order to recognize different degrees of wear. Alternatively or additionally, it may be provided that the depth of the encircling spiral marking can decrease in the direction of the lengthwise axis of the drill string section, for example to 0 mm (again). Thus, an encircling spiral marking can be provided which at first increases in depth in the direction of the lengthwise axis of the drill string section and then decreases again in its further course in the direction of the lengthwise axis. Different starting and ending values of the encircling spiral marking are possible. A symmetrical arrangement of the encircling spiral marking in terms of depth may offer the advantage that a control function is possible in regard to uniform abrasion. Different degrees of abrasion can be ascertained by means of a marking which can vary along its extension.

Several identical markings on the drill string section are possible, in order to provide a control function. The identical markings may be present at different angular positions with respect to the lengthwise axis of the drill string section. The identical markings may also alternatively or additionally be spaced apart from each other in regard to their position in the direction of the lengthwise axis.

In one preferred embodiment, identical or different markings may be arranged spaced apart from each other on several segments of the drill string section. This may offer manufacturing benefits, since an encircling spiral marking is not needed. But it may also be provided to provide, alongside each other on the drill string section, both an encircling spiral marking and multiple identical or different markings spaced apart from each other. The spacing of the multiple identical or different markings may occur in particular in the direction of the lengthwise axis of the drill string section.

Variations of different markings and identical markings are possible, so that different markings and identical markings alternate, while several identical or different markings may be present alongside each other and be adjacent to a number of identical or different markings. A substantially symmetrical arrangement of markings offers the advantage that changes in the markings can be more easily identified. Furthermore, an arrangement of markings alongside each other may afford the benefit that only one place on the drill string section needs to be viewed.

The extension of multiple markings—whether identical or different in configuration—may be different or the same along the circumferential direction of the drill string section for the markings. For example, markings of the same depth may have a different extension in the circumferential direction. It may also be provided that different markings (different depth) have a substantially equal extension in the circumferential direction. A pattern may be present by means of the marking or markings, whose appearance is optimized for the recognizing of a change. Symmetry with respect to an axis along a circumference may be helpful for the recognizing of a change in the marking or markings.

In a preferred embodiment, the marking or the markings may be rounded in the lengthwise extension radially to the lengthwise axis of the drill string section. This shape can avoid or at least lessen the notch effects.

The invention also creates a ground drilling device with a drill string, in particular as has been described above. The ground drilling device moreover comprises a drive unit, which is designed to introduce a drill string comprising the drill string section into the ground.

The invention also creates a use of a drill string section for drilling in the ground, wherein a marking is used on the outside of the drill string section by means of which abrasion can be recognized.

The remarks of the specification pertaining to the aspect of the drill string section apply accordingly to the aspect of the use of a drill string section.

In an especially preferred embodiment, the drill string section is a housing of a percussion drilling device for drilling in the ground, in which a main piston is arranged in the housing for a reciprocating motion. Straight drill sections which are configured as the housing of a percussion drilling device may be exposed to an increased wear, especially on account of the action of the main piston on the housing, so that for this kind of drill string sections an especially simple and easily handled recognition of wear by means of the abrasion present on the housing of the percussion drilling device is possible.

The term "percussion drilling device" or "displacement hammer", which is used substantially synonymously with "percussion drilling device", encompasses in the sense of the specification a self-driven percussion apparatus which works by earth displacement and which can introduce a conduit or a pipe into the ground by percussion. The term "percussion drilling device" encompasses both earth displacement devices in which the drill bit tip is firmly connected to the housing and percussion drilling devices with drill bit tip mounted axially displaceable independently of the housing. The drill bit tip may be in particular a chisel. A percussion drilling device may be either a single-stroke device or a two-stroke device. In a two-stroke device, at first the main piston strikes the drill bit tip, which has run in advance of it in the first stroke. The housing is struck in the second stroke by the main piston. Tip resistance and casing friction are easier to overcome in a two-stroke device in a separate and alternating manner. In a two-stroke device, there is a better conversion of energy, which makes it easier to crush obstacles on account of the concentration of the percussion impulse on the drill bit tip. Due to the earth displacement in advance of the stroke travel of the drill head, the housing remains in a position of rest and thereby assures a relatively good running stability.

In a preferred embodiment, more than one marking can be arranged on the drill string section. In this way, in particular, different degrees of abrasion can be identified. Preferably, the markings may be present in different configuration in order to identify each time a degree of abrasion by means of a marking. The markings may also be arranged differently in particular in their type, position, dimension and/or orientation by which they are arranged on the outside of the drill string section. In particular, the markings may have different depths. In the sense of the specification, the term "depth" encompasses the extension of the depression in a direction radial to the lengthwise extension of the drill string section. In this way, by providing several markings, such as two, with different depths, two or more degrees—depending on the number of total markings—can be identified. Depending on which of the markings having a different depth is or are still visible or not visible when the drill string section is inspected by the user due to the abrasion on the drill string section during use or after use, the degree of wear of the drill string section may be inferred, without costly measurement instruments being required. This makes possible a decision not only as to whether the drill string section is coming close to a possible section of its service life, but also what degree of abrasion or wear is present, so that not only the end of life, but also degrees in between, can be identified accordingly.

Alternatively or additionally, the markings in a preferred embodiment may have different widths, for example, the markings are present as V-shaped depressions or rounded depressions with different slopes of the sides—in order to form the different widths—on the outside of the drill string section. The width of the markings also decreases due to the increasing wear caused by the continuing use of the drill string section.

A preferred embodiment has markings of different depths and/or widths, wherein the width and/or depth can be chosen such that the different markings can indicate a different degree of wear on the drill string section, regardless of which marking is still recognizable—or even not recognizable. A preferred arrangement of these markings, especially uniformly graduated markings, can be the following: the markings on the drill string section are arranged transversely, especially orthogonally, to the direction of the lengthwise axis of the drill string section, preferably in the mirror image with respect to an axis transverse to the lengthwise direction of the drill string section. This may begin with the marking or markings having the greatest depth, which may be for example 0.5 mm. Further markings, such as those with a depth of 0.3 mm and 0.15 mm, may be arranged toward or away from the drill head, starting from the marking or markings having the greatest depth, especially in mirror image.

The foregoing remarks, as well as the following description of exemplary embodiments, do not constitute any waiving of particular embodiments or features.

BRIEF DESCRIPTION OF THE DRAWINGS

The invention shall be explained more closely in the following as an example with the aid of two exemplary embodiments represented in the drawings.

The drawings show.

DETAILED DESCRIPTION

Figure 1:
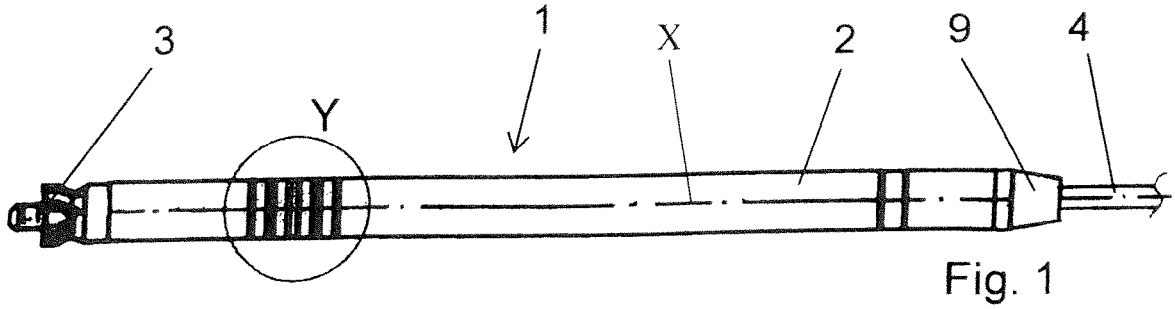
FIG. 1 illustrates a drill string section designed as a percussion drilling device with markings.

FIG. 1 shows a drill string section 1 configured as a percussion drilling device, having a housing 2, inside which a main piston is arranged (not visible). The main piston is supplied with pressurized air via a pressurized air hose 4, in order to execute reciprocating movement inside the housing 2. The main piston may be actuated so that it either strikes in the front region of the percussion drilling device to propel the percussion drilling device with the drill head 3 forward through the ground, or it strikes in the rear region of the percussion drilling device in order to drive it backwards. In the front region of the drill string section 1, designated as Y and shown enlarged in FIG. 2, markings 5, 6, 7 are arranged on the housing 2 of the percussion drilling device. The markings 5, 6 7 make it possible to recognize different degrees of abrasion on the housing 2. The abrasion occurring on the housing 2, increasing over time, is caused by the resistance of the ground during the course of the drilling.

Figure 2:
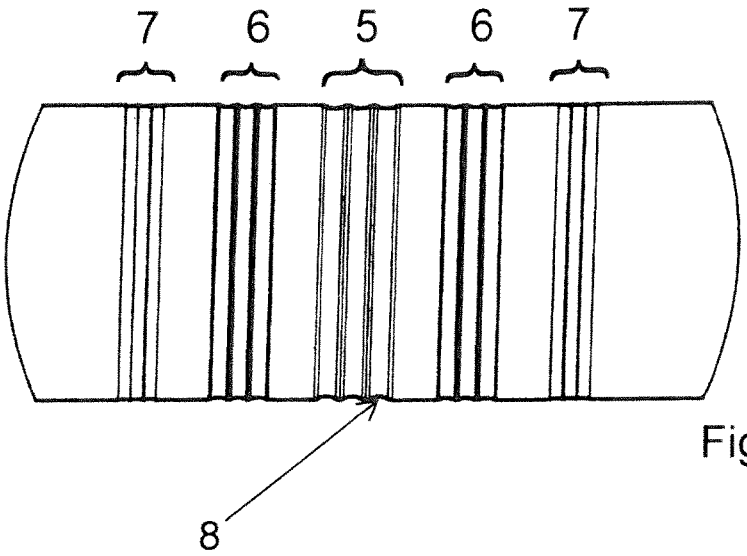
FIG. 2 illustrates an enlarged cut-out view with markings from FIG. 1.

FIG. 2 shows, highly enlarged, the cut-out Y from FIG. 1. Three grooves configured as depressions 7 have been machined each time in the direction of the drill head 3 and in the direction of the end 9 of the drill string section 1. These outer depressions 7 have a machining depth of 0.15 mm. In later use, whether during the advancement or during the backward operation of the drill string section 1 designed as a percussion drilling device, the material on the outside of the housing 2 is worn away by abrasion so much that at first the depressions 7 are hardly or not at all recognizable. This indicates the start of the wear on the drill string section 1 or the housing 2 and it enables a first estimation as to when the housing 2 needs to be replaced, insofar as it is worn down. In turn, each time further spaced away from the drill head 3 and from the end 9 of the percussion drilling device than the already described three depressions 7, there are arranged three depressions 6. These three depressions 6 have been machined with a depth of 0.3 mm. After continuing use and thus continuing wear on the housing 2 of the percussion drilling device, the material ablation on the housing 2 has proceeded to such an extent that the three depressions 6 are also hardly or not at all recognizable. This means already an intense wear on the housing 2, however the further use of the drill string section 1 designed as a percussion drilling device is still possible. However, it may be assumed that the housing 2 will have to be replaced within a short time. The preparations needed for this may now be made already. In the middle between the aforementioned depressions 6, 7 there are arranged a further three depressions 5. These three depressions 5 are 0.5 mm deep. If, in the further course of the use of the drill string section 1 designed as a percussion drilling device, the further material ablation occurs to such an extent that these deeper three depressions 5 are also hardly or not at all recognizable, at least the housing 2 must be replaced, or else there will occur a fracturing of the housing 2 and thus a total loss of the percussion drilling device in the ground and naturally also a failure of the drilling project. All of the aforementioned depressions 5, 6, 7 have a radius 8 in order to prevent a premature fracturing of the housing 2 due to the notch effect at the depressions 5, 6, 7.

Figure 3:
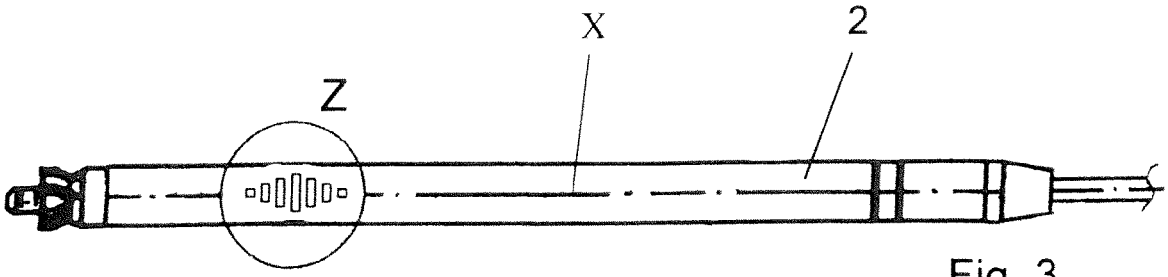
FIG. 3 illustrates another embodiment of a drill string section designed as a percussion drilling device with markings and FIG. 4 illustrates an enlarged region of FIG. 3 with markings on the drill string section.

FIG. 3 shows as an example another possible embodiment of the markings 5, 6, 7 for the recognition of wear on a housing 2. In this embodiment, instead of encircling depressions 5, 6, 7, there are machined groove-like depressions 10, 11, 12 of different depth in the housing 2, extending only across a partial region of the circumference.

Figure 4:
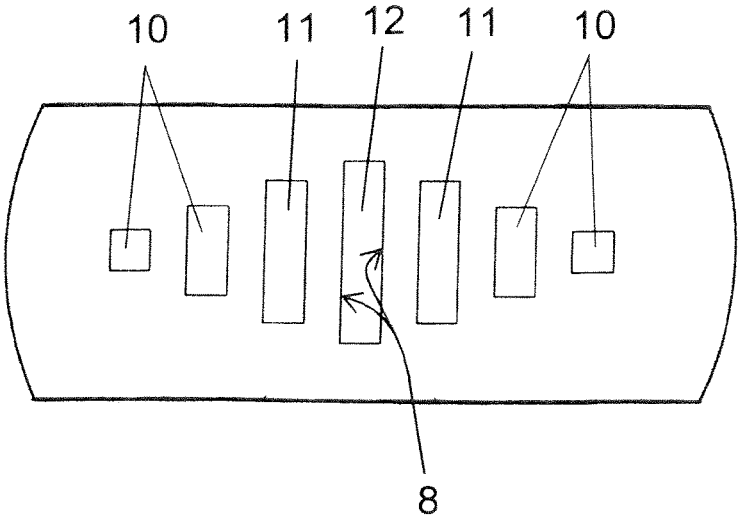

FIG. 4 shows a highly enlarged representation of the cut-out Z of FIG. 3. The depressions 10 here play the role of the three depressions 7 of FIG. 1. The depressions 11 are analogous to the three depressions 6 of FIG. 1 and the depression 12 indicates, like the three depressions 5 of FIG. 1, the need to replace the housing 2. The depressions 10, 11, 12 are likewise provided with radii 8 in order to avoid a notch effect.

The invention claimed is:

1. A drill string section of a drill string for drilling in the ground, wherein on the outside of the drill string section there is arranged a plurality of markings along the circumferential direction of the drill string by which abrasion can be recognized, wherein the plurality of markings are spaced apart along the longitudinal axis of the drill string and at least two of the plurality of markings have a different extension in the circumferential direction.

2. The drill string section according to claim 1, wherein the drill string section is a housing of a percussion drilling device for drilling in the ground, in which a main piston is arranged for a reciprocating motion.

3. The drill string section according to claim 1, wherein each of the plurality of markings have a different configuration.

4. The drill string section according to claim 1, wherein each of the plurality of markings have a different depth radial to the lengthwise axis of the drill string section.

5. The drill string section according to claim 1, wherein each of the plurality of markings have different widths in the direction of the lengthwise axis (X) of the drill string section.

6. The drill string section according to claim 4, wherein the depths of the plurality of markings are chosen such that different degrees of abrasion are identifiable.

7. The drill string section according to claim 1, wherein the plurality of markings are arranged spaced apart from each other on several regions of the drill string section.

8. The drill string section according to claim 1, wherein each of the plurality of markings comprises a rounded depression which is rounded along the lengthwise axis (X) of the drill string section.

9. A drill string for a horizontal drilling device for drilling in the ground, comprising:

a drill string section including an outer surface in which there is formed multiple sets of depressions along the circumferential direction of the drill string by which abrasion can be recognized, wherein the depressions in each set of the multiple sets have a same depth, and wherein at least two of the multiple sets have depressions of a different depth relative to another one of the multiple sets.

10. The drill string of claim 9, wherein the depressions in each of the multiple sets has the same length in the circumferential direction.

11. The drill string of claim 10, wherein at least one of the multiple sets has depressions of a different length in the circumferential direction than another one of the multiple sets.

12. The drill string of claim 9, wherein the depressions are V-shaped.

13. The drill string of claim 9, wherein the depressions are rounded.

14. The drill string of claim 9, wherein at least one of the multiple sets has depressions of a different length in the circumferential direction.

15. A percussion drilling device for drilling in the ground, comprising:

a housing including an outer surface in which there is formed a plurality of depressions along the circumferential direction of the housing by which abrasion can be recognized, wherein the plurality of depressions comprise a plurality of identical markings at different angular positions with respect to the lengthwise axis of the housing, thereby providing a control function in relation to uniform abrasion; and a main piston arranged in the housing for a reciprocating motion.

16. The drilling device of claim 15, wherein the plurality of depressions are spaced apart along the longitudinal axis of the housing and at least two of the plurality of markings have a different extension in a circumferential direction.

17. The drilling device of claim 15, wherein the plurality of depressions are configured as multiple sets of depressions along the circumferential direction of the housing, wherein the depressions in each set of the multiple sets has a same depth, and wherein each of the multiple sets has depressions of a different depth relative to each of the other multiple sets.

18. The drilling device of claim 15, wherein the plurality of depressions are machined into the housing.

19. The drilling device of claim 15, wherein the plurality of depressions comprise an encircling spiral marking and multiple markings spaced apart from each other in the direction of the lengthwise axis of the drill string section.

* * * * *